US007257851B1

(12) United States Patent
Nakamura

(10) Patent No.: US 7,257,851 B1
(45) Date of Patent: Aug. 21, 2007

(54) PILLOW BOOK

(75) Inventor: Michael L. Nakamura, Crystal Lake, IL (US)

(73) Assignee: Senario, LLC, Woodstock, IL (US)

( * ) Notice: Subject to any disclaimer, the term of this patent is extended or adjusted under 35 U.S.C. 154(b) by 0 days.

(21) Appl. No.: 11/345,577

(22) Filed: Feb. 1, 2006

(51) Int. Cl.
*A47G 9/10* (2006.01)
*B42D 1/00* (2006.01)

(52) U.S. Cl. ..... 5/639; 5/640; 281/15.1; 283/63.1

(58) Field of Classification Search ..... 5/640, 5/636, 639; 281/15.1, 29, 38, 46; 283/63.1; 412/3–5
See application file for complete search history.

(56) References Cited

U.S. PATENT DOCUMENTS

| | | | | | |
|---|---|---|---|---|---|
| 784,477 | A | | 3/1905 | Dean | 281/15.1 |
| 1,306,691 | A | * | 6/1919 | Goetz | 281/29 |
| 3,738,686 | A | * | 6/1973 | Morse | 283/63.1 |
| 3,849,810 | A | | 11/1974 | Degen | 5/640 |
| 4,227,270 | A | | 10/1980 | Rivera | 5/639 |
| 4,280,241 | A | | 7/1981 | Pfaff | 412/3 |
| 4,524,993 | A | | 6/1985 | Walker-Taylor | 281/46 |
| 4,689,844 | A | | 9/1987 | Alivizatos | 5/702 |
| 4,768,245 | A | * | 9/1988 | Dutton | 5/636 |
| 4,853,994 | A | | 8/1989 | Ekstein | 5/639 |
| 4,874,340 | A | | 10/1989 | Smallwood | 446/28 |
| 4,909,542 | A | * | 3/1990 | Marks | 281/15.1 |
| 5,059,149 | A | * | 10/1991 | Stone | 446/73 |
| 5,765,245 | A | | 6/1998 | Breto | 5/640 |
| 5,987,676 | A | | 11/1999 | Littleford et al. | 5/636 |
| 6,061,943 | A | * | 5/2000 | Pepys | 40/771 |
| 6,742,809 | B2 | * | 6/2004 | Frosig et al. | 281/21.1 |

FOREIGN PATENT DOCUMENTS

| | | | |
|---|---|---|---|
| EP | 0 707 822 | A1 | 4/1996 |
| EP | 1 260 163 | A2 | 11/2002 |
| GB | 2 130 085 | A | 5/1984 |
| JP | 2002209698 | A | 7/2002 |
| JP | 2004049546 | A | 2/2004 |

* cited by examiner

*Primary Examiner*—Robert G. Santos
(74) *Attorney, Agent, or Firm*—Pauley Petersen & Erickson

(57) ABSTRACT

A pillow book with flexible fabric sheets disposed between to pillow covers. A first pillow includes a first pillow interior edge portion and a second pillow includes a second pillow interior edge portion. The second pillow interior edge portion is connected to the first pillow interior edge portion. The pillow book includes a plurality of leaves connected to the first and second pillows and disposed between the first and second pillows when the pillow book is in a closed position. Each of the plurality of leaves has a leaf interior edge portion disposed between and connected to the first pillow interior edge portion and the second pillow interior edge portion. The leaves are formed from a single folded fabric sheet. Each of the plurality of leaves defines a pocket containing a nonwoven support sheet.

16 Claims, 2 Drawing Sheets

PILLOW BOOK

BACKGROUND OF THE INVENTION

This invention relates generally to a pillow book, and, more particularly, to a pillow book having printed fabric pages between two pillow-like book covers.

SUMMARY OF THE INVENTION

A general object of the invention is to provide a pillow book having an improved connection or seam connecting two pillows and the fabric pages therebetween. The pillow book of this invention also provides a support for thin fabric pages, thereby making the pages relatively easier for the consumer to manipulate.

The general object of the invention can be attained, at least in part, through a pillow book including a first pillow including a first pillow interior edge portion and a second pillow including a second pillow interior edge portion. The second pillow interior edge portion is connected to the first pillow interior edge portion. The pillow book also includes a plurality of leaves. Each of the plurality of leaves comprises a leaf interior edge portion disposed between and connected to the first pillow interior edge portion and the second pillow interior edge portion.

The invention further comprehends a pillow book comprising a first pillow including a first pillow interior edge portion and a second pillow including a second pillow interior edge portion. The second pillow interior edge portion is connected to the first pillow interior edge portion. The pillow book includes a plurality of leaves connected to the first and second pillows and disposed between the first and second pillows when the pillow book is in a closed position. The plurality of leaves are formed from a single folded fabric sheet. Each of the plurality of leaves defines a pocket containing a nonwoven support sheet.

Other objects and advantages will be apparent to those skilled in the art from the following detailed description taken in conjunction with the appended claims and drawings.

DETAILED DESCRIPTION OF THE INVENTION

The present invention provides a pillow book. The pillow book has two pillows which form the front and back covers of the pillow book, respectively. The pillow book includes a plurality of leaves formed of a fabric material and disposed between the two pillows. The fabric leaves are desirably printed on either side to provide pages for the pillow book.

Figure 2:
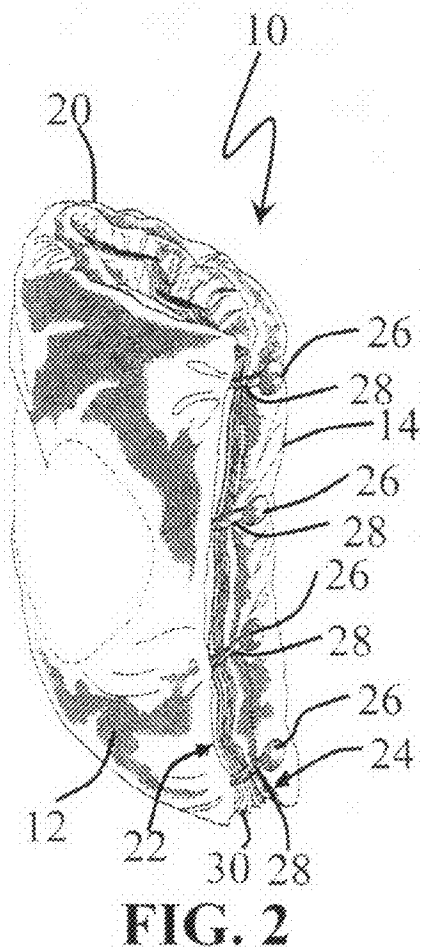
FIG. 2 is a perspective view of the pillow book of FIG. 1, in a closed position.
Figure 1:
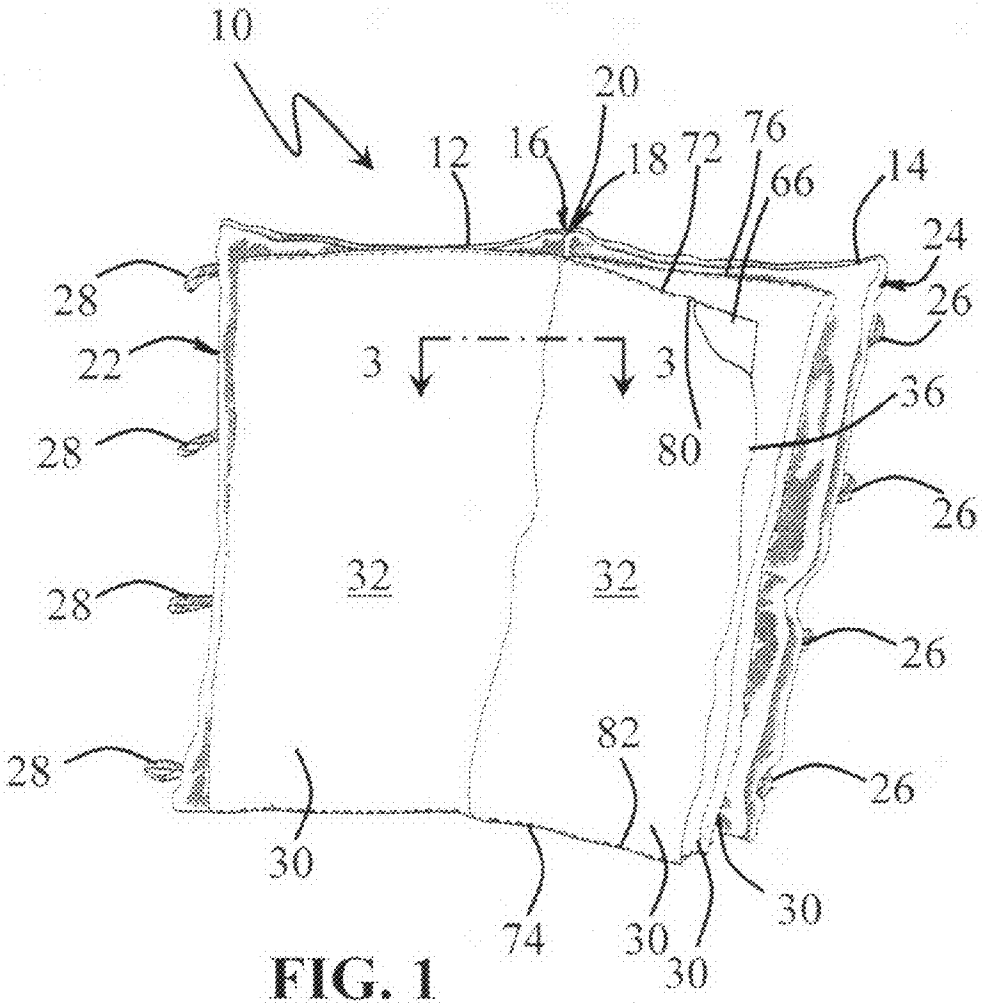
FIG. 1 is a partial sectional perspective view of a pillow book, in an open position showing exposed pages, according to one embodiment of this invention.
Figure 3:
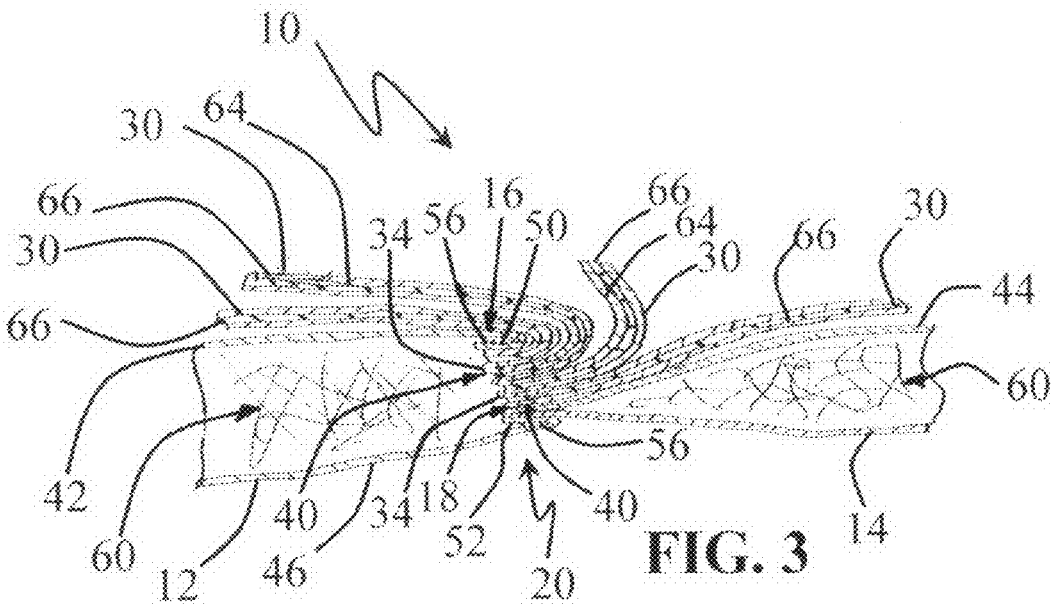
FIG. 3 is a partial sectional view of the pillow book of FIG. 1, taken along line 3-3.

An exemplary embodiment of the pillow book 10 is shown in FIGS. 1-3. FIG. 1 shows the pillow book 10 in an open position, while FIG. 2 shows the pillow book 10 in a closed position. The pillow book 10 includes a first pillow 12 and a second pillow 14. The first pillow 12 is the front cover of the pillow book 10 and can optionally be printed with text and/or graphics. The second pillow 14 is the back cover of the pillow book 10. The first pillow 12 has a first pillow interior edge portion 16 disposed at or toward a seam 20 of the pillow book 10. The second pillow 14 has a second pillow interior edge portion 18 also disposed at or toward the seam 20 of the pillow book 10. The second pillow interior edge portion 18 is connected to the first pillow interior edge portion 16 at the seam 20.

The first pillow 12 has a first pillow exterior edge portion 22 disposed at opposite side from the first pillow interior edge portion 16. Similarly, the second pillow 14 has a second pillow exterior edge portion 24 disposed at an opposite side from the second pillow interior edge portion 18. The pillow book 10 desirably includes a plurality of fasteners for holding the pillow book 10 in the closed position shown in FIG. 2. The fasteners are desirably positioned at or along the first pillow exterior edge portion 22 and the second pillow exterior edge portion 24. The fasteners are adapted to secure the first pillow exterior edge portion 22 to the second pillow exterior edge 24 when the pillow book 10 is in a closed position.

As shown in FIGS. 1 and 2, the fasteners are embodied as four buttons 26 disposed along the second pillow exterior edge portion 24. Four corresponding loops 28 are disposed along the first pillow exterior edge portion 22. Each of the plurality of loops 28 are adapted to fit over and around a correspondingly aligned one of the plurality of buttons 26, as shown in FIG. 2, to secure the pillow book 10 in the closed position. As will be appreciated by those skilled in the art following the teachings herein provided, the positions of the buttons 26 and the loops 28 can be reversed or alternatingly positioned. As will also be appreciated, various and alternative fasteners available in the art can be used for the fasteners of the pillow book of this invention, such as, for example, snaps, zippers, and/or hook and loop fasteners.

The pillow book 10 includes a plurality of leaves 30. Each of the leaves 30 provides two page surfaces 32, thereby forming two pages of the pillow book 10. In a preferred embodiment of this invention, such as shown in FIGS. 1-3, the plurality of leaves 30 is formed from a single folded sheet of fabric. In such an embodiment, each of the plurality of leaves 30 is separated from an adjacent one of the plurality of leaves 30 by a fold, such as one of the interior edge folds 34. Likewise, each page surface 32 is separated from an adjacent page surface 32 by a fold, such as one of the interior edge folds 34 or the exterior edge folds 36.

As shown in FIG. 3, each of the plurality of leaves 30 includes a leaf interior edge portion 40. The leaf interior edge portions 40 are disposed between and connected to the first pillow interior edge portion 16 and the second pillow interior edge portion 18. In the embodiment shown in FIG. 3, the first pillow 12 includes a first pillow inner side 42 and the second pillow 14 includes a second pillow inner side 44, which form the inside surfaces of the front and back covers of the pillow book 10, respectively. The leaf interior edge portion 40 of each of the leaves 30 is disposed between the first pillow inner side 42 and the second pillow inner side 44. Also in the embodiment of FIG. 3, the first pillow inner side 42 and a first pillow outer side 46 are folded back to form folded sections 50 and 52, respectively, for the connection to the leaf interior edge portions 40. Desirably, the leaf interior edge portion 40 of each of the plurality of leaves 30 is connected between the first pillow interior edge portion 42 and the second pillow interior edge portion 44 by a plurality of stitches 56.

The construction of the pillow book 10 according to one embodiment of this invention is relatively simple and cost-effective. The plurality of leaves 30 can be formed by printing the desired text and/or graphics of each page of the pillow book 10 consecutively on one side of a single fabric sheet. The fabric sheet is folded multiple times, to form folds 34 and 36, thereby forming the leaves 30. As discussed above, each page 32 of the pillow book 10 is separated from an adjacent page 32 by a fold. The leaf interior edge portions 40 of the leaves 30 are then stitched to and/or between the first pillow interior edge portion 16 and the second pillow interior edge portion 18. As will be appreciated by those skilled in the art following the teachings herein provided, various and alternative stitches and stitching types known are available for assembling the pillows, leaves, and pillow book of this invention.

Various and alternative fabrics can be used to construct the pillow book 10, and more particularly the pillows 12 and 14 and the leaves 30. Examples of fabrics useful in constructing the pillow book of this invention include natural and synthetic fabrics, such as, without limitation, cotton, rayon, and polyester materials. Desirably, the portions of the pillow book which are printed on, e.g., the leaves and optionally the pillow inner and/or outer sides, are made from materials that are appropriate for printing. The pillow inner sides and outer sides can be formed from the same or different materials. The pillows are desirably stuffed with a natural or synthetic fluff material, for example, cotton, as shown in FIG. 3 as fluff material 60.

In one embodiment of this invention, as the leaves are desirably formed of a flexible fabric sheet, a support sheet is used to support or stiffen the individual leaves. As shown in FIGS. 1 and 3, each of the plurality of leaves 30 defines a pocket 64. Each pocket 64 is formed between the two folded fabric portions of each of the leaves 30. A support sheet 66 is disposed in each of the pockets 64. The support sheet 66 is desirably formed from a stiffer material sheet than the fabric leaves 30. The stiffer support sheets 66 provide desirable stiffness for the leaves 30, but still allow the leaves 30 to be flexible and soft. The support sheets 66 can be formed from various and alternative materials. In one embodiment of this invention, the support sheets 66 are made from a nonwoven material, such as a plastic fiber sheet, film, or grid material.

Referring to FIG. 1, each of the plurality of leaves 30 includes a first leaf exterior edge portion 72 extending perpendicularly from the leaf interior edge portion 40. A second leaf exterior edge portion 74 also extends perpendicularly from the leaf interior edge portion 40 on an opposite side of each of the leaves 30 from the first leaf exterior edge portion 72. A first exterior sheet edge 76 of each support sheet 66 is stitched to the first leaf exterior edge portion 72 by stitches 80. On the opposite side, a second exterior sheet edge (not shown) of the support sheet 66 is stitched to the second leaf exterior edge portion 74 by stitches 82. Stitching the support sheet 66 to the corresponding leaf 30 keeps the support sheet 66 from undesirable shifting, falling, and/or bunching within the pocket 64. As shown in FIG. 3, the support sheets 66 are optionally stitched with the leaf interior edge portion 40 to the pillows 12 and 14.

Figure 4:
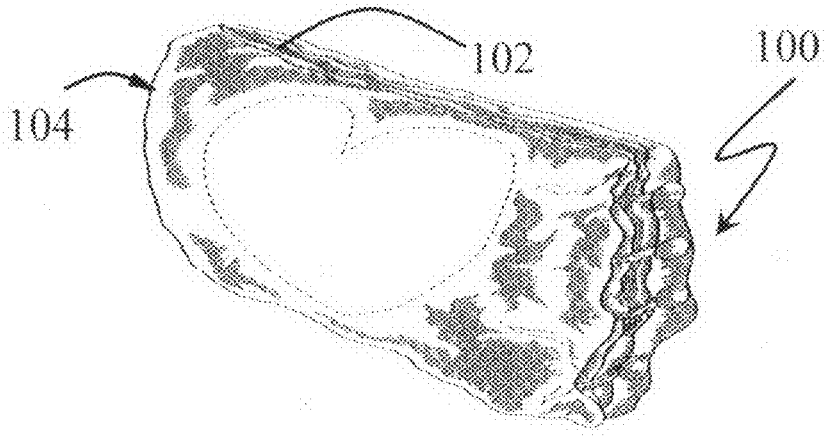
FIG. 4 is a perspective view of a pillow book, in a closed position, according to another embodiment of this invention.

As will be appreciated various and alternative sizes, shapes, and/or configurations are available for the pillow book, the pillows, the leaves, support sheets, seams and stitches of this invention. As shown in FIGS. 1 and 2, the pillow book 10 has an overall rectangular configuration, although other shapes, such as squares, ovals, circles, and triangles, are available as well. The pillow book of this invention can be sized according to need. In one embodiment of this invention, the pillow book has a size of about 1.5 feet to about 3 feet, and more desirably about 2 feet, by about 1.0 feet to about 2.5 feet, and more desirably about 1.5 feet. As shown in FIG. 1, the seam 20 is disposed along a longer edge or side of the rectangular pillow book 10. FIG. 4 illustrates a pillow book 100 according to another embodiment of this invention. In FIG. 4, a seam 102 of the pillow book 100 is disposed along a shorter side 104 of the pillow book. In another alternative embodiment of this invention, the first pillow inner side and the second pillow inner side are each formed at least in part by a portion of the folded sheet of the leaves.

Thus, the invention provides a pillow book having a soft pillow front and back cover and flexible leaves disposed therein. The leaves of the pillow book can be formed of a single folded sheet for efficient and relatively less expensive manufacturing, while providing a relatively strong and aesthetically pleasing seam. The support sheets for the leaves of the pillow book of this invention provide stiffness to make the pillow book easier to use and read, while still maintaining soft and flexible pages.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A pillow book comprising:

a first pillow including a first pillow interior edge portion;

a second pillow including a second pillow interior edge portion, the second pillow interior edge portion connected to the first pillow interior edge portion;

a plurality of leaves, each of the plurality of leaves comprising a leaf interior edge portion disposed between and connected to the first pillow interior edge portion and the second pillow interior edge portion, each of the plurality of leaves defining a pocket containing a support sheet; and each of the plurality of leaves comprising a first leaf exterior edge portion extending from the leaf interior edge portion and a second leaf exterior edge portion extending from the leaf interior edge portion and opposite the first leaf exterior edge portion, wherein a first exterior sheet edge of the support sheet is stitched to the first leaf exterior edge portion and a second exterior sheet edge of the support sheet opposite the first exterior sheet edge portion is stitched to the second leaf exterior edge portion.

2. The pillow book of claim 1, wherein the plurality of leaves consist of a single folded fabric sheet.

3. The pillow book of claim 1, wherein the leaf interior edge portion of each of the plurality of leaves is connected between the first pillow interior edge portion and the second pillow interior edge portion by a plurality of stitches.

4. The pillow book of claim 1, wherein the first pillow includes a first pillow inner side and the second pillow includes a second pillow inner side, and the leaf interior edge portion of each of the plurality of leaves is disposed between the first pillow inner side and the second pillow inner side.

5. The pillow book of claim 1, wherein the plurality of leaves comprises a polyester material.

6. The pillow book of claim 1, wherein each of the plurality of leaves is separated from an adjacent one of the plurality of leaves by a fold.

7. The pillow book of claim 1, wherein the support sheet comprises a nonwoven sheet.

8. The pillow book of claim 1, additionally comprising:

a first pillow exterior edge portion opposite the first pillow interior edge portion;

a second pillow exterior edge portion opposite the second pillow interior edge portion;

a plurality of fasteners, wherein the fasteners are adapted to secure the first pillow exterior edge portion to the second pillow exterior edge when the pillow book is in a closed position.

9. The pillow book of claim 8, wherein each of the plurality of fasteners comprises a button disposed along one of the first pillow exterior edge portion and the second pillow exterior edge portion and a loop disposed along an other of the one of the first pillow exterior edge portion and the second pillow exterior edge portion and adapted to fit over and around the button.

10. A pillow book comprising:

a first pillow including a first pillow interior edge portion;

a second pillow including a second pillow interior edge portion, the second pillow interior edge portion connected to the first pillow interior edge portion;

a plurality of leaves connected to the first and second pillows and disposed between the first and second pillows when the pillow book is in a closed position, the plurality of leaves formed from a single folded fabric sheet, and each of the plurality of leaves defining a pocket containing a nonwoven support sheet; and each support sheet attached to at least one edge of a corresponding one of the plurality of leaves by a plurality of stitches.

11. The pillow book of claim 10, wherein each page of the pillow book is separated from an adjacent page by a fold.

12. The pillow book of claim 10, wherein the fabric sheet comprises polyester.

13. The pillow book of claim 10, wherein each of the plurality of leaves comprises a leaf interior edge portion disposed between and connected to the first pillow interior edge portion and the second pillow interior edge portion.

14. The pillow book of claim 13, wherein the leaf interior edge portion of each of the plurality of leaves is connected between the first pillow interior edge portion and the second pillow interior edge portion by a plurality of stitches.

15. The pillow book of claim 10, additionally comprising:

a first pillow exterior edge portion opposite the first pillow interior edge portion;

a second pillow exterior edge portion opposite the second pillow interior edge portion;

a plurality of fasteners, wherein the fasteners are adapted to secure the first pillow exterior edge portion to the second pillow exterior edge when the pillow book is in the closed position.

16. The pillow book of claim 15, wherein each of the plurality of fasteners comprises a button disposed along one of the first pillow exterior edge portion and the second pillow exterior edge portion and a loop disposed along an other of the one of the first pillow exterior edge portion and the second pillow exterior edge portion and adapted to fit over and around the button.

* * * * *